United States Patent [19]

Hull

[11] Patent Number: 4,846,587

[45] Date of Patent: Jul. 11, 1989

[54] FLACCID BAG HAVING IMPROVED INTEGRALLY FORMED CARRYING HANDLE

[75] Inventor: William J. Hull, Loveland, Ohio

[73] Assignee: The Proctor & Gamble Company, Cincinnati, Ohio

[21] Appl. No.: 251,721

[22] Filed: Sep. 30, 1988

[51] Int. Cl.[4] ..... B65D 33/08

[52] U.S. Cl. ..... 383/10; 206/806

[58] Field of Search ..... 383/10; 206/806, 162, 206/170, 174, 175; 229/52 B

[56] References Cited

U.S. PATENT DOCUMENTS

| | | | |
|---|---|---|---|
| 1,134,341 | 4/1915 | McKendrick . | |
| 2,849,112 | 8/1958 | Forrer | 229/52 B X |
| 3,952,940 | 4/1976 | Malcolm | 229/14 BA |
| 4,031,815 | 6/1977 | Verbeke | 383/10 X |
| 4,134,245 | 1/1979 | Stella | 383/10 X |
| 4,216,899 | 8/1980 | Kamp | 229/54 R |
| 4,595,389 | 6/1986 | Lehmacher | 493/227 |
| 4,811,894 | 3/1989 | Schuster | 229/52 B |

FOREIGN PATENT DOCUMENTS

| | | | |
|---|---|---|---|
| 0038251 | 7/1973 | Australia | 383/10 |
| 0466094 | 6/1950 | Canada | 383/10 |
| 1486729 | 7/1969 | Fed. Rep. of Germany | 383/10 |
| 1919084 | 11/1969 | Fed. Rep. of Germany | 383/10 |
| 1632542 | 3/1970 | Fed. Rep. of Germany | 383/10 |
| 6800239 | 7/1969 | Netherlands | 383/10 |
| 0797755 | 7/1958 | United Kingdom | 383/10 |
| 0960293 | 6/1964 | United Kingdom | 383/10 |
| 1054510 | 1/1967 | United Kingdom | 383/10 |
| 1364688 | 8/1974 | United Kingdom | 383/10 |
| 1396290 | 6/1975 | United Kingdom | 383/10 |
| 2056947 | 3/1981 | United Kingdom | 383/10 |

*Primary Examiner*—Stephen Marcus
*Assistant Examiner*—Kathryn M. Stemann
*Attorney, Agent, or Firm*—E. Kelly Linman; John V. Gorman; Richard C. Witte

[57] ABSTRACT

A bag comprised of flaccid material and having an improved integrally formed carrying handle which supports the weight of one or more articles contained within the bag with minimal discomfort to the supporting portion or portions of the user's body. The bag includes an uppermost flap containing the improved integrally formed carrying handle. The handle is provided by making a continuous curvilinear slit in the flap, the ends of the slit comprising a pair of inwardly. open arcs. The uppermost ends of the inwardly open arcs are inwardly extended until they transition into a centrally located, upwardly concave arc which connects the two inwardly open arcs to one another. The material adjacent the uppermost portion of the slit helps to provide a greater load bearing surface against the supporting portion or portions of the user's body, while the material adjacent the lowermost portion of the slit forms a lowermost fold helps to reinforce and stiffen the flap and thereby minimize lateral squeezing of the supporting portion or portions of the user's body whenever the bag is lifted or carried by the opening formed at the slit.

10 Claims, 12 Drawing Sheets

FLACCID BAG HAVING IMPROVED INTEGRALLY FORMED CARRYING HANDLE

TECHNICAL FIELD

The present invention relates to a flaccid bag for transporting an article or group of articles from one location to another.

The present invention has further relation, in a particularly preferred embodiment, to a bag comprised of weldable plastic material such as polyethylene, polypropylene or the like.

The present invention has futher relation to such a bag having an uppermost flap formed by securing the front and back walls of the bag to one another above the article or articles contained within the bag.

The present invention has still further relation to such a bag having an improved integrally formed carrying handle comprising a pair of identical, superposed continuous curvilinear slits in said front and back walls of said bag in the aforementioned uppermost flap, said continuous curvilinear slits being so shaped that they minimize the intensity of the stress experienced by the supporting portion or portions of the user's body when the bag is picked up and/or carried by the user.

BACKGROUND ART

Flaccid bags for carrying an article or a multiplicity of articles are very well known in the art.

Flaccid bags comprised of materials such as polyethylene, polypropylene or the like have found widespread use for carrying a wide variety of articles from the point of manufacture all the way to the point of end use by consumers.

One particularly preferred use of such flaccid bags is in the field of disposable absorbent bandages, particularly on products such as sanitary napkins, disposable baby diapers, disposable adult incontinence garments and the like.

Most such bags of disposable absorbent products contain a predetermined quantity of product which is sealed within the bag by the manufacturer. An extension of the bag walls above the manufacturer's seal typically provides an uppermost flap. Conventional practice has been to provide an aperture in the uppermost flap which is large enough to insert the fingers of an average adult human to permit carrying of the bag of product by the handle thus formed in the uppermost flap.

While the shape of the aperture is non-critical when the weight of the bag of product is relatively light, e.g., a few ounces, upwardly convex apertures having a shape is generally shown in U.S. Pat. No. 4,595,389 issued to Lehmacher on June 17, 1986 and hereby incorporated herein by reference do not perform particularly well when the weight of the bag of product is great, e.g., several pounds. In particular, the upwardly convex aperture tends to cause discomfort to that portion of the user's body used to support the bag, i.e., typically the fingers, the palm, the wrist or the arm, due to the relatively small area of contact with the tension carrying portion of the handle when the bag is picked up and/or carried.

An additional difficulty posed by such prior art carrying handles for flaccid bags of product is that cutting an aperture in the front and back wall of the uppermost flap requires disposal of the material cut from the flap, thereby necessitating an additional handling operation by either the manufacturer or the end user.

Attempts to overcome some of the aforementioned difficulties have been made, particularly with respect to flaccid bags for handling large quantities of disposable absorbent baby diapers. One such approach involves placing a continuous, upwardly open curvilinear slit in both the front and back walls of the package in the uppermost flap area, but leaving the opposed ends of the slit unconnected to one another. Insertion of the user's fingers causes the flap of material created in the front and back walls of the package to assume a substantially horizontal orientation, thereby creating a fold connecting the opposed ends of each upwardly open slit across the top of the aperture thus formed in the flap. While the increased area of contact between the folded portion of the flap and the supporting portion or portions of the body, typically the fingers, reduces the intensity of the stress experienced by the user's fingers when compared to upwardly convex apertures of the type described in the aforementioned patent to Lehmacher, further improvements in carrying comfort are nonetheless desirable.

OBJECTS OF THE INVENTION

It is therefore an object of the present invention to provide a flaccid bag for carrying one or more articles, said bag having an improved integrally formed carrying handle which supports the weight of the article or articles contained within the bag with minimal discomfort to the user when the bag is picked up and/or carried.

It is another object of the present invention to provide such a bag having an improved integrally formed carrying handle which can be formed as a slit in the pliable walls of the bag without the need for additional reinforcing materials.

It is another object of the present invention to provide such a bag having an improved integrally formed carrying handle which can be fabricated on existing production equipment by installation of a curvilinear-shaped cutting die exhibiting the improved profile and orientation of the present invention.

DISCLOSURE OF THE INVENTION

In a particularly preferred embodiment, the present invention comprises a bag formed of flaccid, preferably polymeric, material, said bag having an improved integrally formed carrying handle which supports the weight of one or more articles contained within the bag with minimal discomfort to the user during lifting and/or carrying. The bag comprises a front wall and a back wall preferably fabricated from a flaccid polymeric material such as polyethylene film.

The bag is closed at its lowermost end and along its sides to form a cavity for housing the article or articles. The innermost surfaces of the front and back walls are horizontally secured to one another at a first area located vertically above the articles in the bag. The front and back walls of the bag extend upwardly beyond the first area of horizontal securement to a second area of horizontal securement where the innermost surfaces of the front and back walls are again horizontally secured to one another. That portion of the front and back walls of the bag located between the first and second areas of horizontal securement form an uppermost flap containing the improved integrally formed carrying handle. The improved carrying handle comprises a pair of identical, superposed, continuous curvilinear slits in the front and back walls of the flaccid bag. Each continuous curvilinear slit has opposed end portions, each defined by an outermost inwardly open arc located on a common horizontal axis. The uppermost portions of the inwardly open arcs are inwardly and downwardly extended until they transition into a centrally located, upwardly concave arc connecting the outermost inwardly open arcs to one another.

Insertion of the user's fingers through the opening formed by the pair of identical, superposed, continuous curvilinear slits causes the portion of the flap immediately above the centrally located, upwardly concave arc and the portion of the flap immediately below the centrally located, upwardly concave arc to assume a substantially horizontal orientation before the handle thus formed is subjected to tension.

The portion of the flap immediately below the centrally located, upwardly concave arc forms a fold connecting the opposing end points of each curvilinear slit to one another. The fold reinforces and tends to stiffen the lowermost portion of the opening formed in the flap when the handle is subjected to tension. In addition, the substantially horizontal orientation of the portion of the flap immediately above the centrally located, upwardly concave arc increases the area of load bearing contact with the user's fingers. Both of these responses to tension applied to the handle help to minimize the intensity of the stress experienced by the user's fingers when the bag is lifted and/or carried by the improved integrally formed carrying handle of the present invention.

BRIEF DESCRIPTION OF THE DRAWINGS

While the specification concludes with claims particularly pointing out and distinctly claiming the present invention, it is believed the present invention will be better understood from the following description in conjunction with the accompanying drawings in which:

DETAILED DESCRIPTION OF THE PRESENT INVENTION

Figure 1:
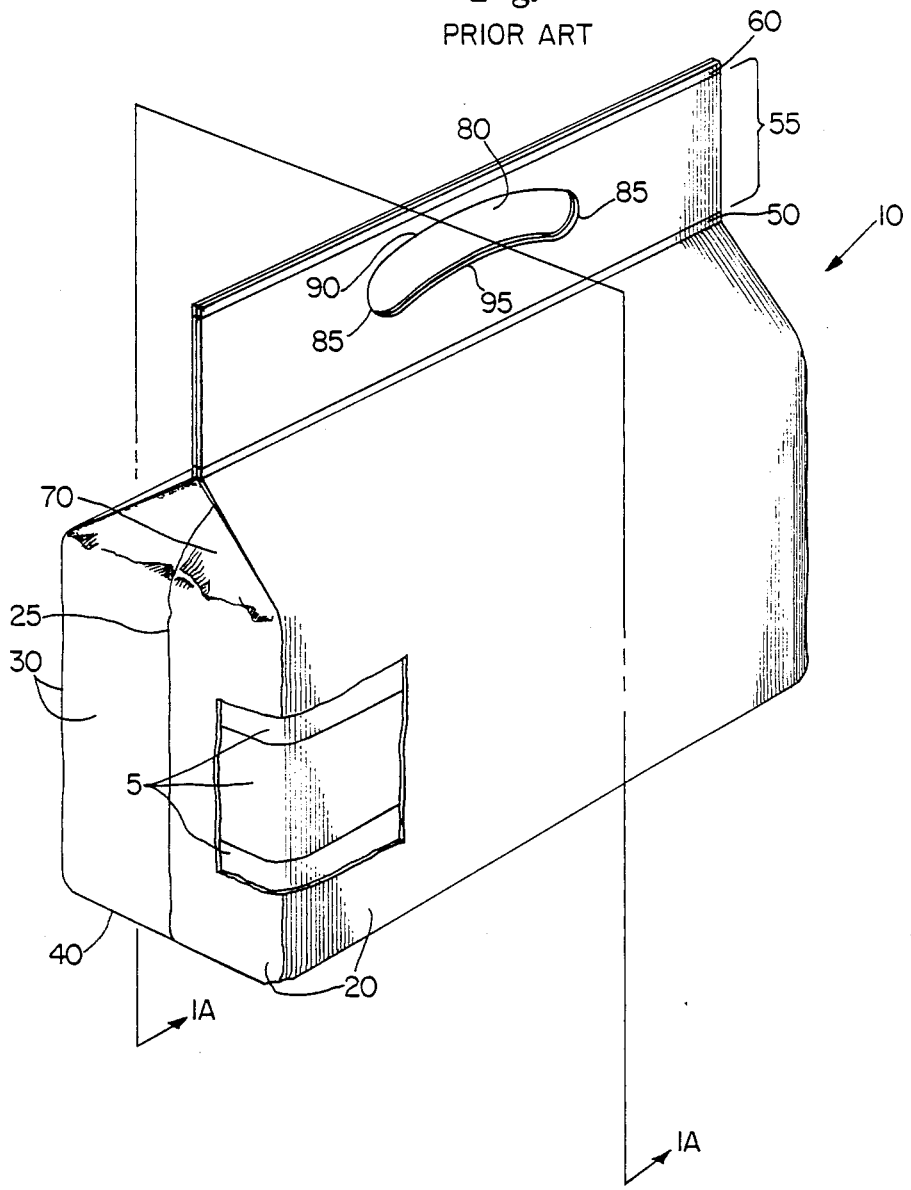
Fig. 1 PRIOR ART
FIG. 1 is a simplified perspective illustration of a typical prior art flaccid bag containing a multiplicity of articles and employing an upwardly convex aperture which serves as a handle in its uppermost flap.

In FIG. 1 there is illustrated a flaccid bag 10 comprised of a heat weldable film such as polyethylene, polypropylene or the like. The bag contains a multiplicity of articles 5 which, for example, may be disposable baby diapers. While the precise manner in which the bag 10 is formed is noncritical, in the illustrated embodiment a front wall 20 and a back wall 30 are shown joined to one another along a heat seal indicated as 25. The bottom 40 of the bag 10 can also be closed in any desired manner, as by heat sealing or the like.

In the illustrated embodiment, the innermost surfaces of the front wall 20 and back wall 30 are continuously sealed to one another above the products 5 contained within the bag along a first area of horizontal securement 50, thereby forming a pair of opposed, inwardly folded gussets 70 and totally enclosing the articles 5 within the bag. The front wall 20 and back wall 30 extend upwardly beyond the first area of horizontal securement 50 to a second area of horizontal securement 60 where the innermost surfaces of the front and back walls of the bag are again horizontally secured to one another. That portion of the front and back walls of the bag located between the first and second areas of horizontal securement 50, 60, respectively, form an uppermost flap 55.

In the bag embodiment 10 illustrated in FIG. 1, the prior art handle provided in uppermost flap 55 comprises an upwardly convex aperture 80, which is normally sufficiently large to permit insertion of a portion of the user's body therethrough. This is typically the fingers, the palm of the hand, the wrist or the arm. In the embodiment illustrated in FIG. 1, the aperture 80 is sized to accommodate insertion of the user's fingers, exclusive of the thumb.

Figure 1A:
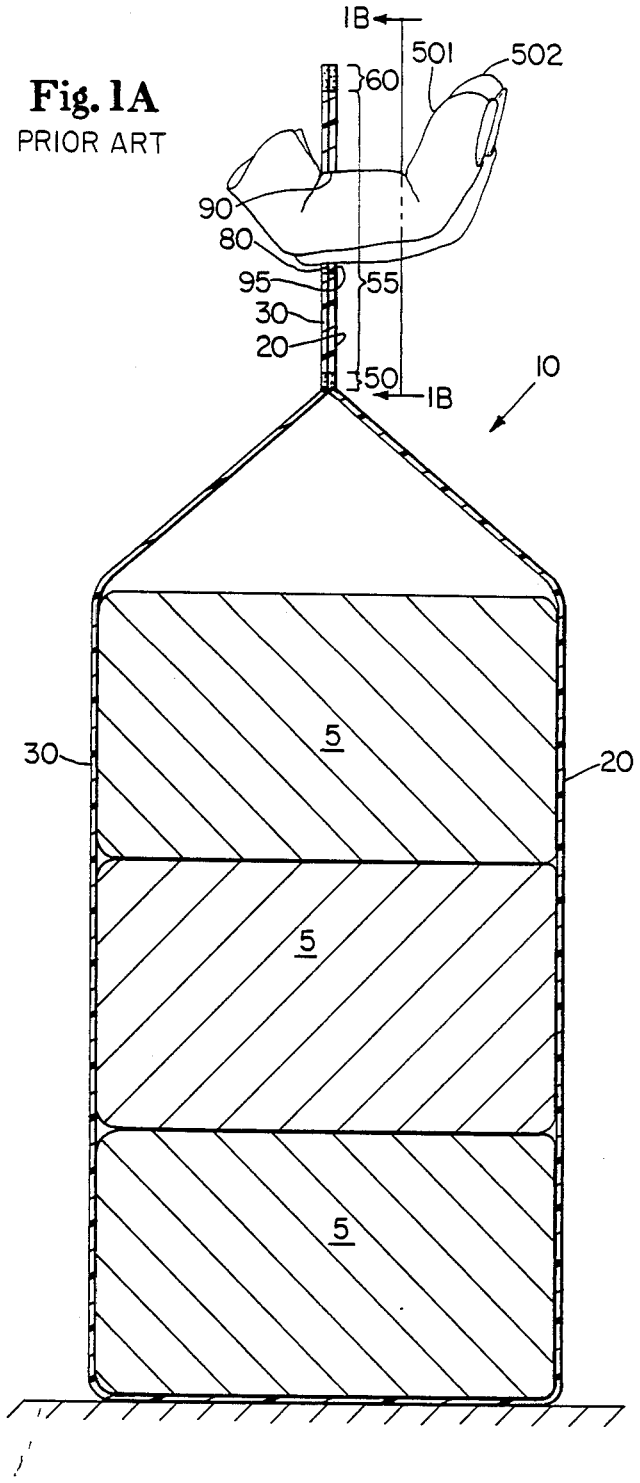
Fig. 1A PRIOR ART
FIG. 1A is a cross-sectional view of the prior art bag shown in FIG. 1 after the user's fingers have been inserted through the aperture, but before the bag has been lifted.
Figure 1B:
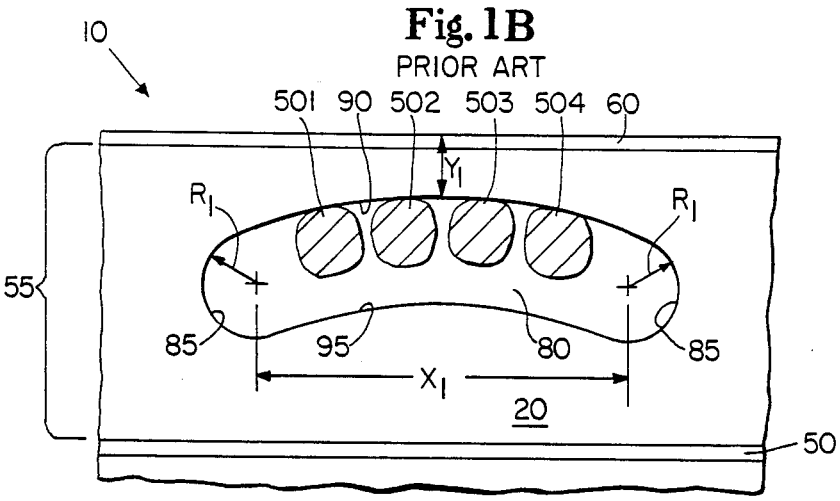
Fig. 1B PRIOR ART
FIG. 1B is an illustration of the prior art bag of FIG. 1A taken along view line 1B—1B of FIG. 1A, said view showing the areas of contact between the handle and the user's fingers prior to lifting of the bag.

The aperture 80, which is representative of the prior art, comprises a lowermost arcuate segment 95 and an uppermost arcuate segment 90 connected to one another at their end points by means of semicircles 85 having a radius $R_1$, as generally shown in FIG. 1B.

FIG. 1A is a simplified cross-section showing the condition which would exist after the user's fingers have been inserted through the aperture 80, but before the bag 10 is lifted. As will be apparent from the cross-section of FIG. 1A, the principal area of contact between the user's fingers and the bag is limited to the uppermost cut edge of arcuate portion 90 of the aperture.

FIG. 1B is an illustration, taken along view line 1B—1B of FIG. 1A, showing the condition which exists prior to subjecting the handle to tension by lifting of the bag 10. Prior to lifting the bag 10, the user's fingers 501, 502, 503 and 504 are comfortably separated from one another and are not subject to any appreciable loading from the cut edges of the uppermost arcuate portion 90 of aperture 80 in flap 55. The semicircular ends 85 of aperture 80 each exhibit a radius $R_1$, and the radii of the semicircles 85 are separated from one another by a horizontal distance $X_1$. The vertical distance between the uppermost point on arcuate portion 90 of the aperture 80 and the second area of horizontal securement 60 of the front and back walls of the bag to one another is indicated at $Y_1$.

Figure 1C:
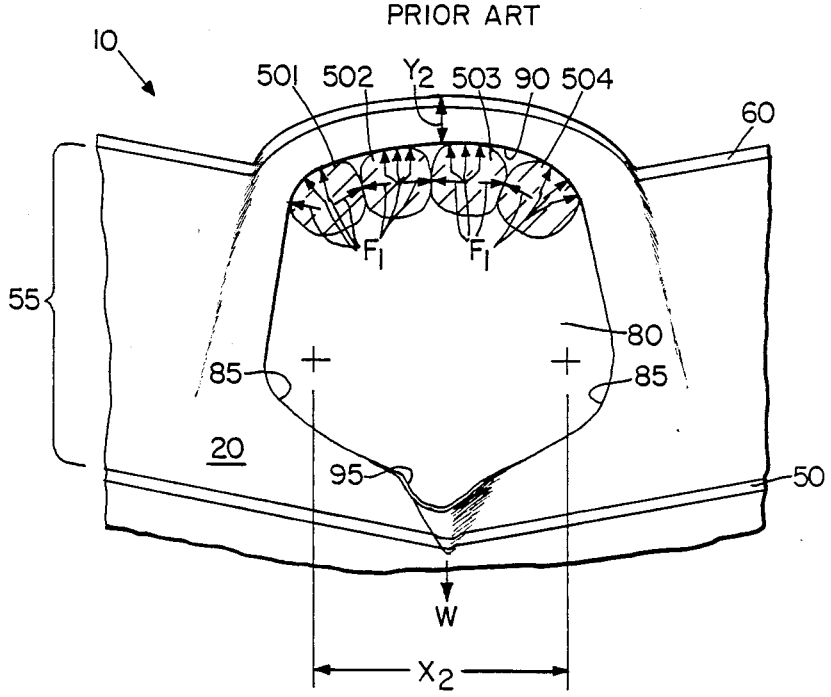
Fig. 1C PRIOR ART
FIG. 1C is a view generally similar to that of FIG. 1B, but showing the condition which normally exists after the bag has been lifted by its handle.

FIG. 1C, which illustrates the condition that exists upon lifting of the bag 10, depicts what happens to the aperture 80 in uppermost flap 55 when the handle is subjected to tension due to the weight W of the bag. In particular, the horizontal distance between the centerlines of semicircles 85 is substantially reduced to a new horizontal distance $X_2$. In addition, lowermost arcuate portion 95 of aperture 80 undergoes substantial wrinkling and distortion due to the horizontal shortening of aperture 80.

As can also be seen from FIG. 1C, horizontal shortening of the aperture 80 tends to cause the user's fingers 501, 502, 503 and 504 to move into contact with one another. Thus, stress is exerted against the user's fingers not only by the cut edges of the uppermost arcuate portion 90 of aperture 80, but also by the user's fingers being squeezed against one another, as represented by arrows $F_1$ in Drawing FIG. 1C. This produces an unpleasant squeezing sensation on the user's fingers. Furthermore, because of the limited contact area between the user's fingers and the cut edges of uppermost arcuate portion 90 of aperture 80, the discomfort level increases as the weight W of the bag increases. If the weight W of the bag is of sufficient magnitude, the vertical distance from the uppermost point on arcuate portion 90 of aperture 80 to the second horizontal area of securement 60 may also decrease to a new and shorter distance $Y_2$ due to necking down of the material comprising the flap in the area of the handle. This can, in some instances, lead to premature failure of the handle due to ripping of the flap in the area between uppermost arc 90 of aperture 80 and secondary area of horizontal securement 60, with consequent dropping of the bag.

Figure 2:
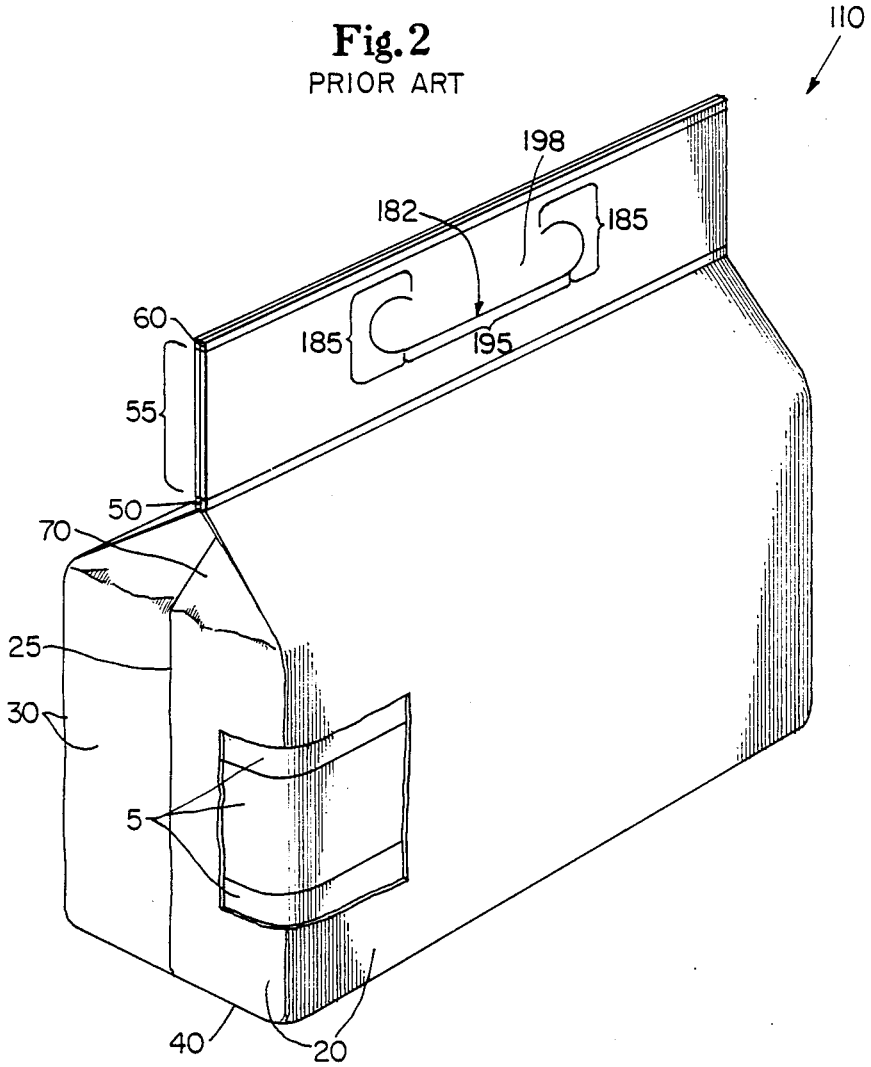
Fig. 2 PRIOR ART
FIG. 2 is a perspective illustration of a prior art flaccid bag containing a multiplicity of articles generally similar to the bag shown in FIG. 1, but employing a single curvilinear slit of the type generally known in the prior art to provide a carrying handle in its uppermost flap.

In FIG. 2 there is shown another flaccid bag 110 generally similar to bag 10 shown in FIG. 1. However, flaccid bag 110 shown in FIG. 2 differs from bag 10 shown in FIG. 1 with respect to the prior art handle provided in uppermost flap 55. In particular, a pair of identical, superposed, continuous slits 182 in the front and back walls of the bag are used to form the handle in bag 110. Each slit 182 comprises a pair of inwardly open arcs 185 having their lowermost ends connected to one another by means of a substantially straight line 195.

Figure 2A:
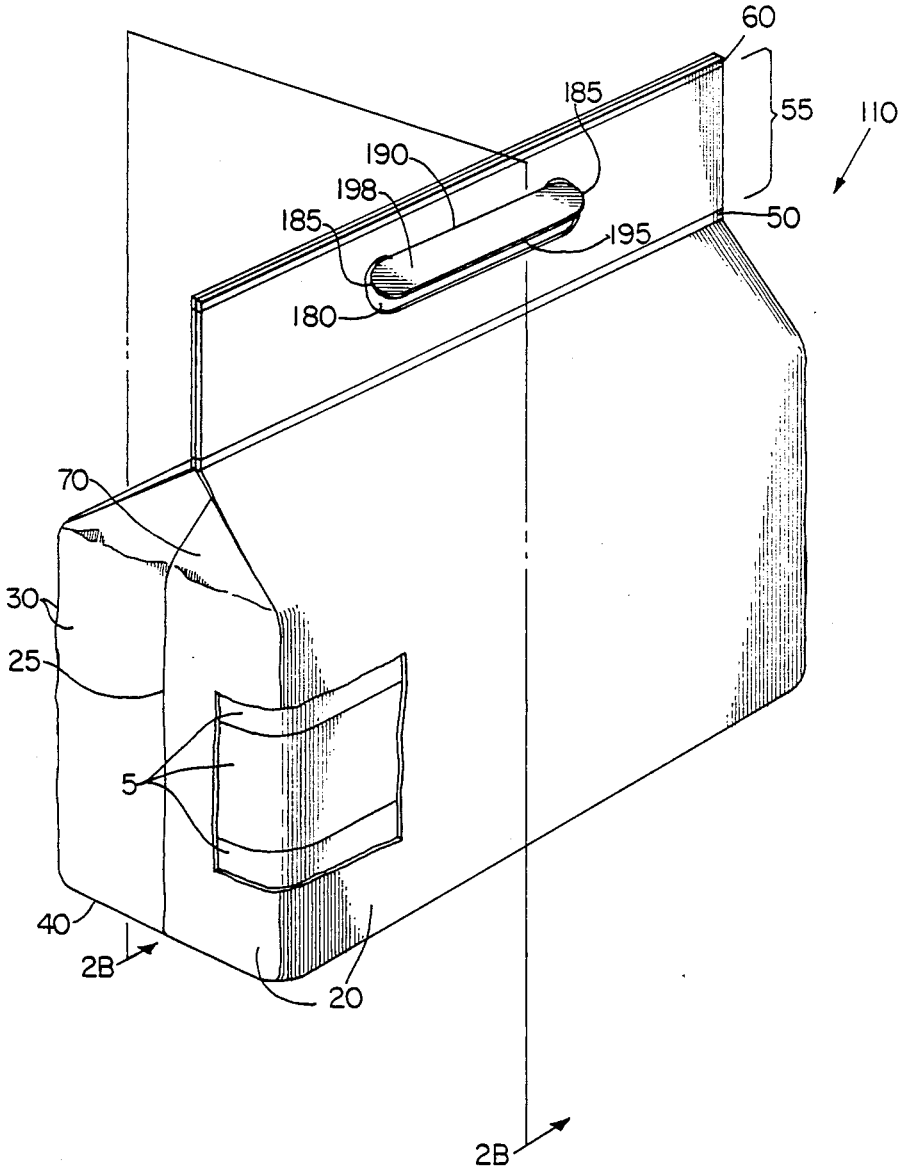
Fig. 2A PRIOR ART
FIG. 2A is an illustration of the prior art bag shown in FIG. 2 illustrating the condition which would exist in the uppermost flap after the user's fingers (not shown) are inserted through the slit.

FIG. 2A shows the manner in which the flap material defined within slits 182 is horizontally extended about a fold line 190 to provide an aperture 180 in flap 55 when the user's fingers are inserted through the slit. (Note that for purposes of clarity the user's fingers are not shown in FIG. 2A.)

The folded portion 198 of flap 55 is comprised of front wall and back wall material. The cross-section of FIG. 2B, which is taken along section line 2B—2B of FIG. 2A, illustrates the manner in which the folded portion 198 of flap 55 provides a horizontal load bearing surface which contacts the user's fingers.

Figure 2B:
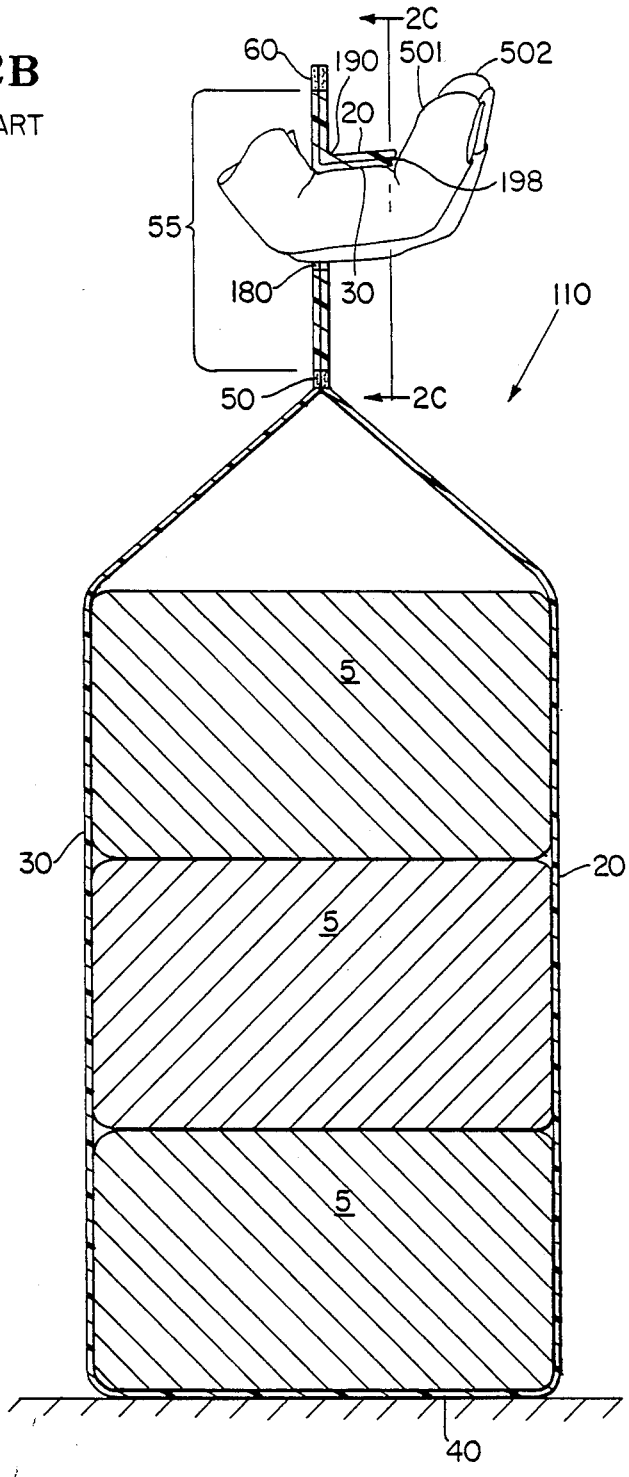
Fig. 2B PRIOR ART
FIG. 2B is a cross-sectional illustration of the prior art bag shown in FIG. 2A taken along section line 2B—2B of FIG. 2A, but illustrating the user's fingers positioned through the opening formed at the slit, said bag being shown prior to being lifted by its handle.
Figure 2C:
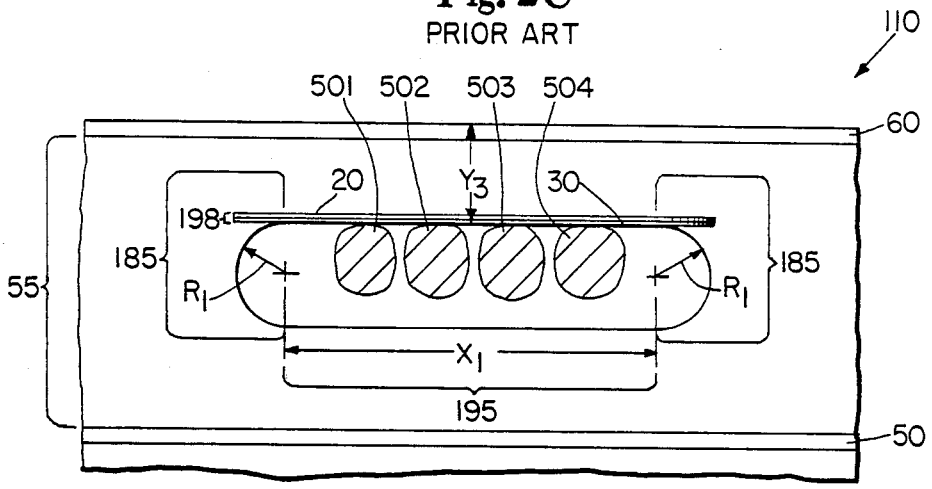
Fig. 2C PRIOR ART
FIG. 2C is an illustration of the prior art bag shown in FIG. 2B taken along view line 2C—2C of FIG. 2B.

FIG. 2C, which is an illustration taken along view line 2C—2C of FIG. 2B, depicts the condition which exists prior to lifting of the bag 110. Note particularly that the user's fingers 501, 502, 503 and 504 are separated from one another and that the inwardly facing arcs 185 of radius $R_1$ have their centerlines separated from one another by a horizontal distance $X_1$, essentially the same as that shown with respect to semi circles 85 of bag embodiment 10 illustrated in FIG. 1B.

Figure 2D:
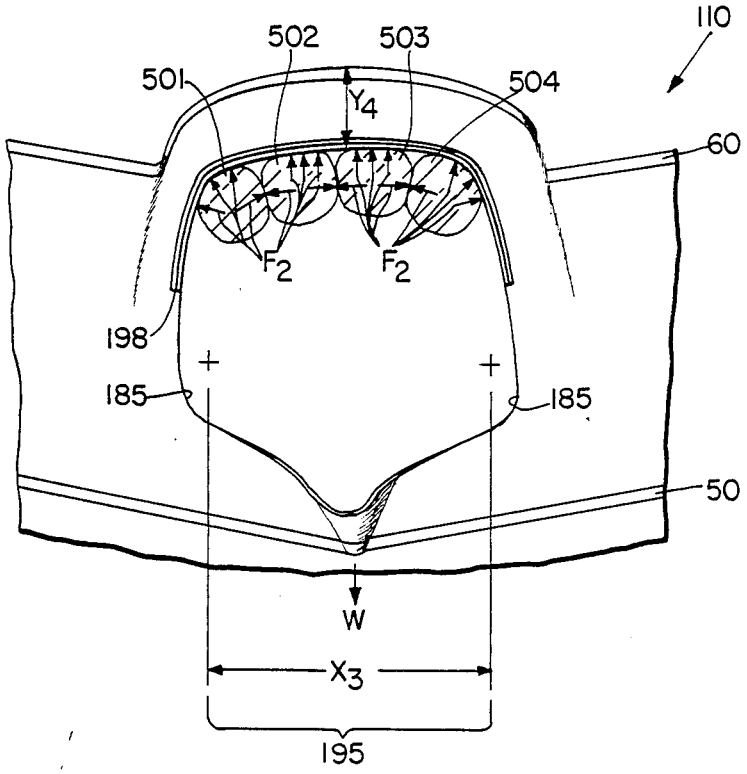
Fig. 2D PRIOR ART
FIG. 2D is a view generally similar to that of FIG. 2C, but showing the condition which normally exists after the bag has been lifted by its handle.

Lifting the bag 110 of weight W produces the reaction generally shown in FIG. 2D. In particular, the centerlines of arcs 185 move horizontally closer to one another, as represented by horizontal distance $X_3$, while the initially straight portions 195 of the slits 182 undergo substantial wrinkling and distortion due to the compressive loads which result at the bottom of aperture 180. As with bag embodiment 10, this causes discomfort by squeezing the user's fingers against one another.

The vertical distance between the folded portion 198 of flap 55 and the second area of horizontal securement 60 may also decrease from the vertical distance $Y_3$ shown in FIG. 2C to a new and shorter distance $Y_4$ as the weight W of the bag 110 induces tension in the handle portion of the flap. However, this decrease is generally less than for bag 10 for any given weight W, due to the fact that more material is present to carry the tensile load. In this regard note particularly that even if vertical distance $Y_3$ for bag 110 is identical to vertical distance $Y_1$ for bag 10, some of the tensile load applied to the handle of bag 110 will be carried by the folded portion 198 of flap 55 on the latter embodiment. This additional material will further resist necking.

While it will be appreciated that the greater degree of contact between the supporting portion of the user's body and the folded portion 198 of flap 55 in FIG. 2C will reduce the intensity of the stresses encountered by the user (represented by arrows $F_2$ in FIG. 2D) relative to the stresses encountered with prior art bag embodiment 10 of FIG. 1 (represented by arrows $F_1$ in FIG. 1C), further reductions in the intensity of the stress experienced by the supporting portion of the user's body are nonetheless desirable.

Figure 3:
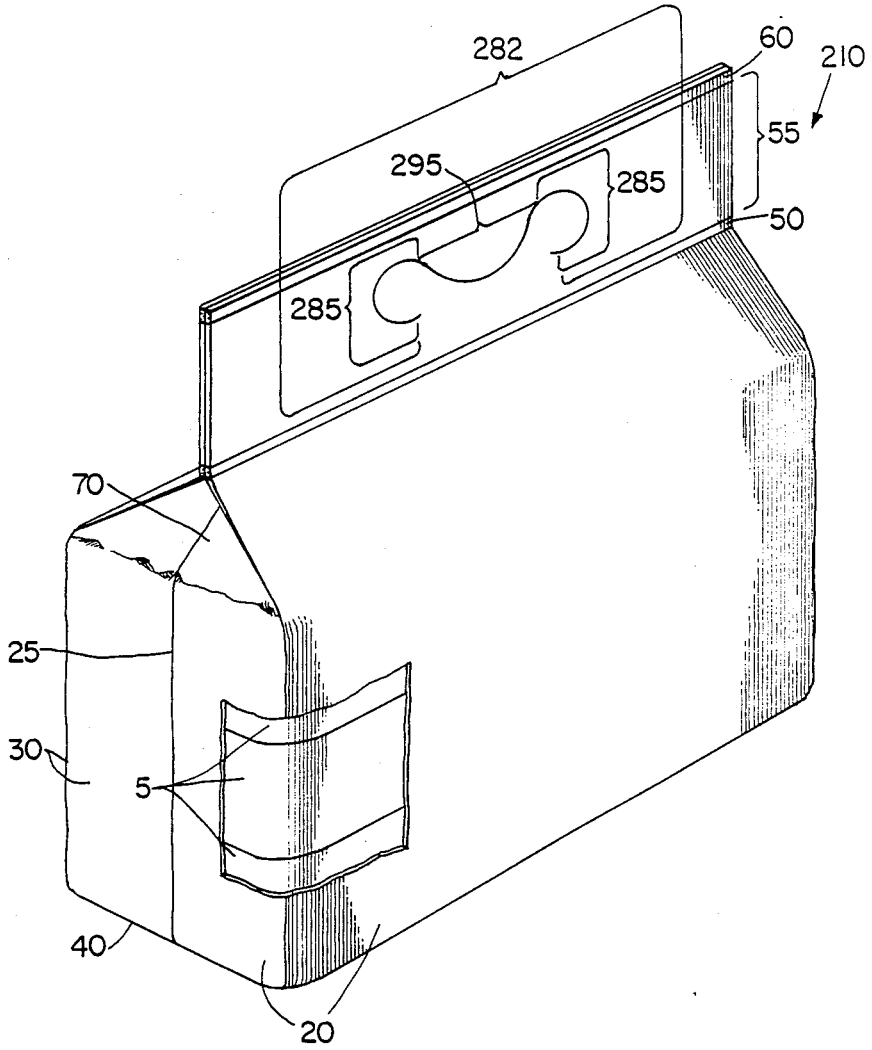
FIG. 3 is a perspective view of a flaccid bag generally similar to those of FIGS. 1 and 2, but employing an improved integrally formed carrying handle of the present invention in its uppermost flap.

FIG. 3 shows still another flaccid bag embodiment 210 which is generally similar to embodiments 10 and 110 shown in FIGS. 1 and 2, respectively. However, bag embodiment 210 employs an improved integrally formed carrying handle of the present invention in the uppermost flap 55 of the bag. The improved integrally formed carrying handle comprises a pair of identical, superposed, continuous curvilinear slits 282 in the front and back walls of the flaccid bag in the flap area 55. (As used herein, the term "continuous" when used to describe the curvilinear slits in handles of the present invention is intended to include slits which may employ small frangible tabs of the flap material to hold them in place in the flap until such time as the handle is actually placed in service by the end user.) Each of the continuous curvilinear slits 282 has an opposed end portion defined by an outermost inwardly open arc 285, which in the illustrated embodiment comprises a semicircle. Each of the outermost inwardly open arcs 285 is located on a common horizontal axis, and the uppermost portions of the inwardly open arcs are inwardly and downwardly extended until they transition into a centrally located, upwardly concave arc 295 which connects the two outermost arcs 285 to one another. The lowermost point on upwardly concave arc 295 is preferably at a greater vertical elevation than the lowermost point on inwardly open arcs 285.

Figure 3A:
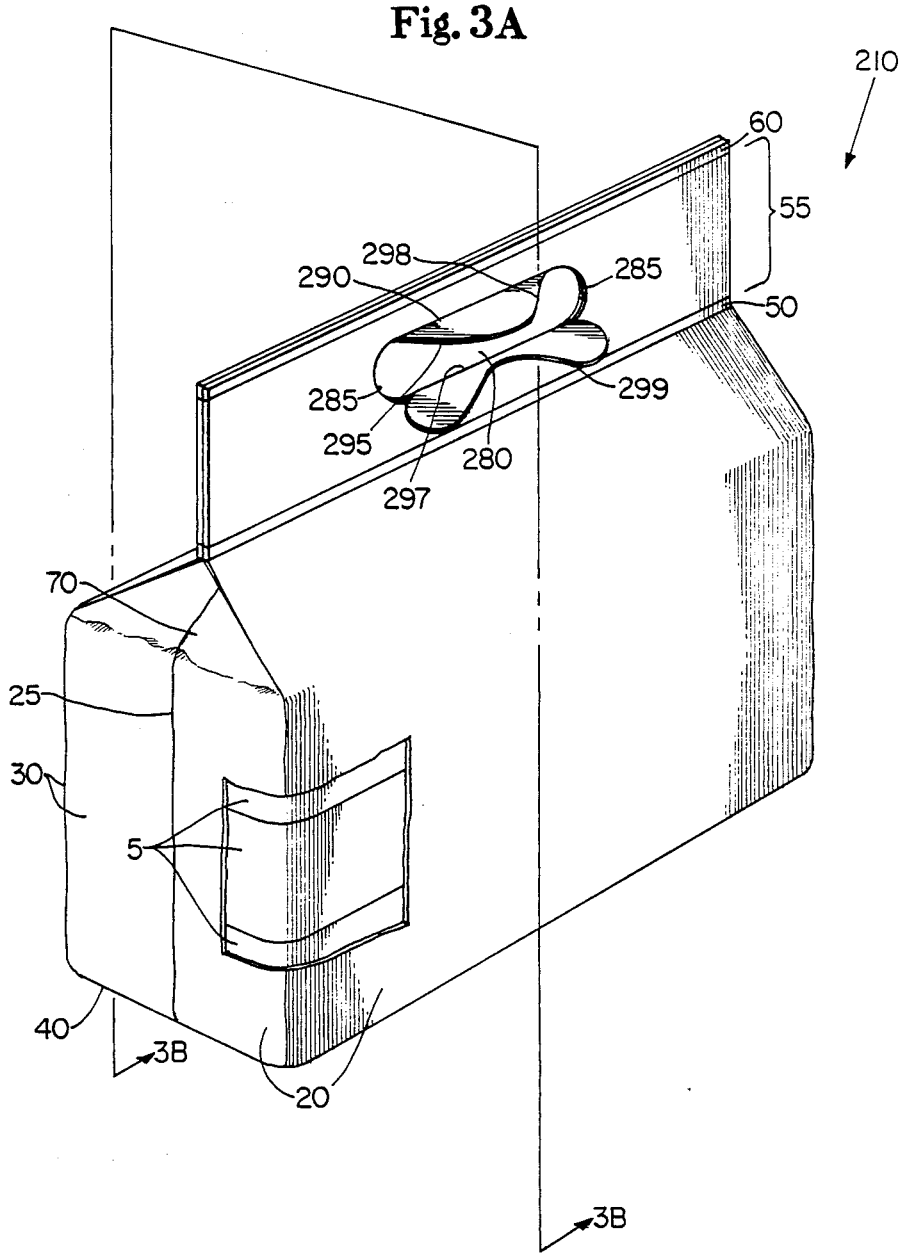
FIG. 3A is a view of the bag shown in FIG. 3, but showing the condition which would exist after the user's fingers (not shown) have been inserted through the opening formed at the curvilinear slit.

FIG. 3A shows the condition which exists when the user's fingers (not shown) are inserted into the area defined by the continuous curvilinear slits 282. The portion of the flap 298 located immediately above the upwardly concave arc 295 assumes a substantially horizontal orientation along fold line 290, which is tangent to the uppermost portions of inwardly open arcs 285. The portion of the flap immediately below the centrally located, upwardly concave arc 295 also forms a fold along fold line 297, which is tangent to the lowermost portions of arcs 285. Thus the lowermost fold, which lies along fold line 297, connects the opposing end points of each curvilinear slit 282 to one another. This lowermost fold tends to stiffen the flap 55 along the bottom portion of the aperture 280 formed therein when the handle of the bag is subjected to tension induced by picking up the bag 210.

Figure 3B:
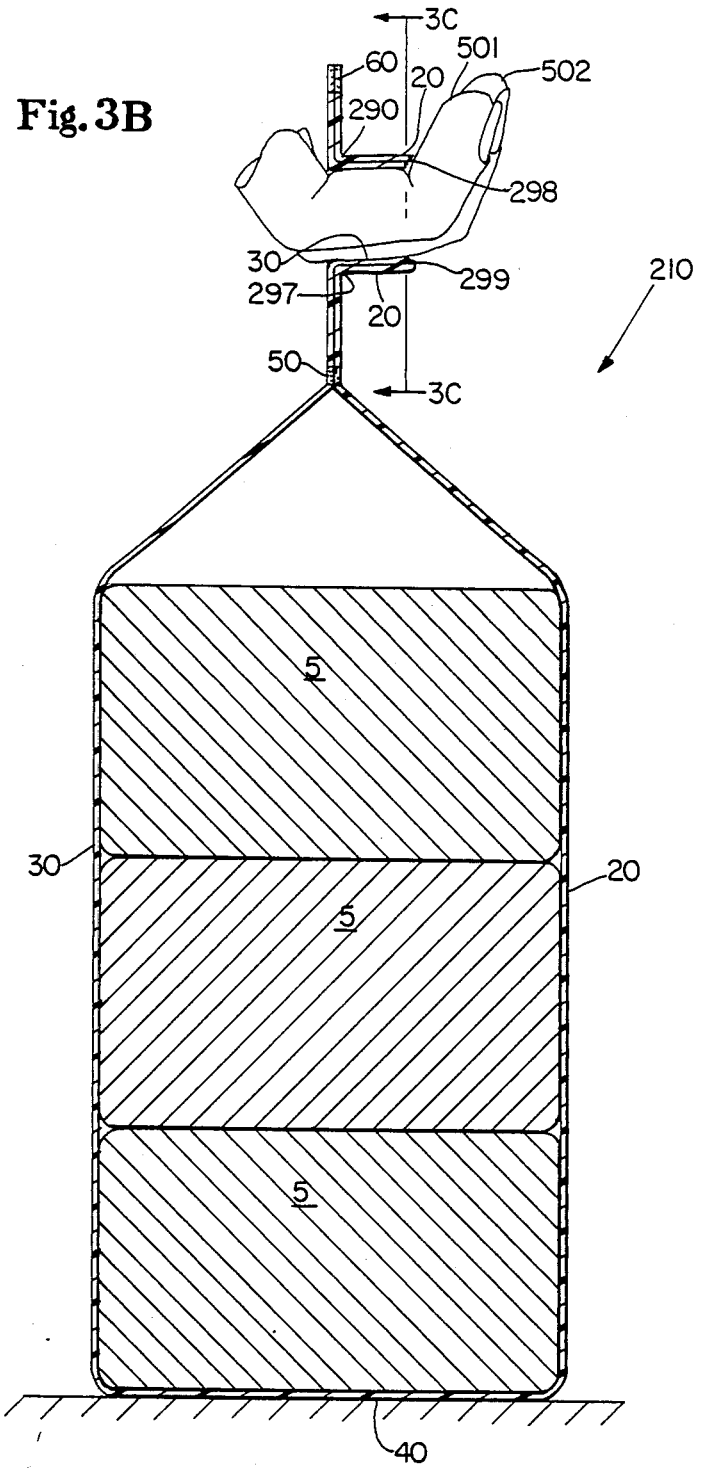
FIG. 3B is a cross-sectional view of the package shown in FIG. 3A taken along section line 3B—3B of FIG. 3A, but showing the user's fingers in place through the opening formed in the flap.

FIG. 3B is a cross-section taken along section line 3B—3B of FIG. 3A showing the user's fingers inserted through the opening formed by the pair of continuous curvilinear slits 282. The uppermost folded portion 298 of the flap 55 helps to distribute the load across the horizontal surfaces of the user's fingers in a manner generally similar to bag embodiment 110 shown in FIG. 2B. However, unlike bag embodiment 110 which employs a prior art carrying handle, the lowermost folded portion 299 of the flap 55 of the bag 210 of the present invention helps to stiffen the opening 280 across its lowermost portion.

Figure 3C:
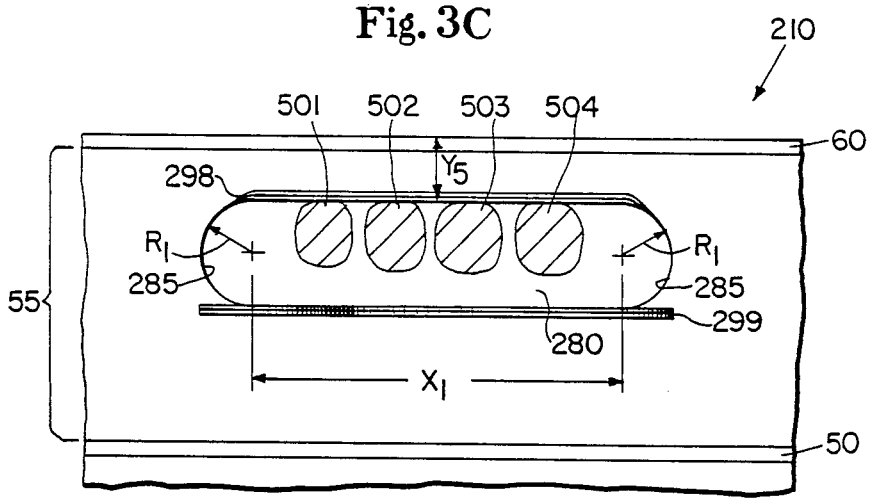
FIG. 3C is an illustration taken along view line 3C—3C of FIG. 3B showing the areas of contact between the user's fingers and the bag prior to lifting of the bag.

FIG. 3C shows the condition which exists prior to lifting of the bag 210, said view being taken along view line 3C'3C of FIG. 3B. As can be seen in FIG. 3C, the user's fingers 501, 502, 503 and 504 are slightly spaced from one another as they would normally be in the absence of any loading. The semicircular inwardly open arcs 285 of radius $R_1$ are located on the same horizontal axis, and their centers are separated by a distance $X_1$, essentially the same as on the prior art carrying handle employed on bag embodiment 110 shown in FIG. 2C. Prior to lifting of the bag, the vertical distance between the uppermost folded portion 298 of flap 55 and secondary area of horizontal securement 60 is indicated as $Y_5$.

Figure 3D:
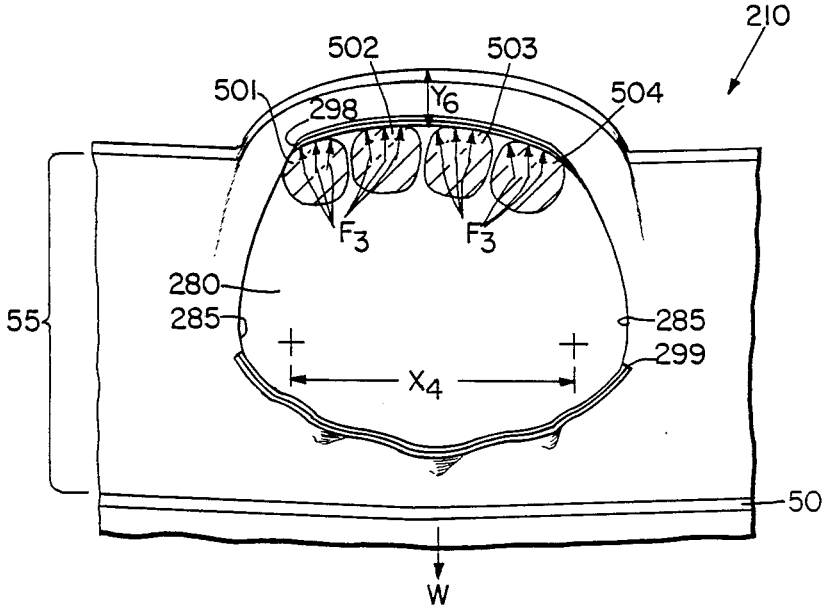
FIG. 3D is a cross-sectional view generally similar to that of FIG. 3C, but showing the condition which normally exists after the bag has been lifted by its handle.

FIG. 3D is a view generally similar to that of FIG. 3C, but showing the condition which exists when the bag 210 having a weight W is lifted by its handle. In particular, the supporting portion or portions of the user's body, in this case fingers 501, 502, 503 and 504, are subjected to stress primarily along their uppermost surfaces, as represented by arrows $F_3$. The tendency of the lowermost portion of the aperture 280 formed in the flap to collapse is, at least to a degree, resisted by the folded portion 299 of flap 55 located adjacent the lowermost portion of opening 280. As can be seen in FIG. 3D, the centers of the inwardly open semicircular arcs 285 have moved horizontally closer to one another to a new distance $X_4$. However, for any given weight W the new horizontal distance $X_4$ will normally be greater than the horizontal distance $X_3$ which results with a prior art carrying handle of the type used on otherwise identical bag 110, as shown in FIG. 2D. This added resistance to collapse adjacent the lowermost edge of aperture 280 in carrying handles of the present invention helps to reduce lateral squeezing of the supporting portion or portions of the user's body. In the embodiment illustrated in FIG. 3D, it minimizes the tendency of the user's fingers to be squeezed against one another when the bag 210 is picked up and/or carried, thereby further reducing discomfort to the user.

Figure 4:
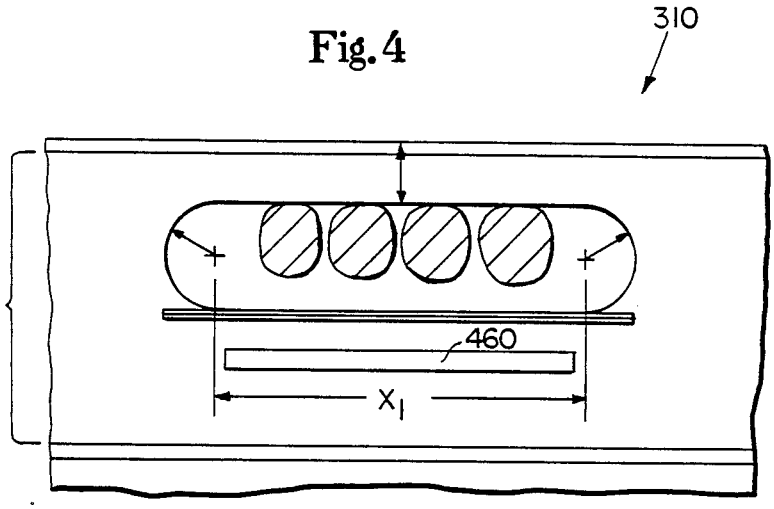
FIG. 4 is a view of a bag generally similar to that of FIG. 3C, but including a flap having its front and back walls secured to one another in an area near the fold line of the handle.

If desired, further stiffening of flap 55 can be imparted by longitudinally heat sealing the front and back walls of the bag to one another in one or more areas adjacent fold line 297. See, for example, optional reinforcing seal 460 in otherwise identical bag embodiment 310 of FIG. 4.

While not wishing to be bound, it is believed that it is the combination of improved resistance to collapse along the lowermost portion of aperture 280 and the relatively large load bearing contact area between the horizontal folded portion 298 of flap 55 which reduce the intensity of the stress experienced by the supporting portion or portions of the user's body when the bag 210 is lifted and transported.

As will be appreciated by those skilled in the art, the stiffer the flaccid material used to fabricate bag 210, the greater will be the stiffening effect provided by the folded over portion 299 of flap 55 adjacent the lowermost edge of aperture 280.

While particular embodiments of the present invention have been illustrated and described, it will be obvious to those skilled in the art that various changes and modifications can be made without departing from the spirit and scope of the invention. It is intended to cover in the appended claims all such modifications that are within the scope of this invention.

What is claimed is:

1. A bag comprised of flaccid material and having an improved integrally formed carrying handle which supports the weight of a multiplicity of articles contained within said bag with minimal discomfort to the supporting portion of the user's body, said bag comprising a front wall and a back wall fabricated from said flaccid material, said bag having a vertical axis and being closed at its lowermost end and along its sides to form a cavity for housing said articles, the innermost surfaces of said front and back walls of said bag being horizontally secured to one another at a first area of horizontal securement located above said articles in said bag so as to totally enclose said articles, said front and back walls of said bag extending upwardly beyond said first area of horizontal securement to a second area of horizontal securement where said innermost surfaces of said front and back walls of said bag are again horizontally secured to one another, that portion of said front and back walls of said bag located between said first and second areas of horizontal securement forming an uppermost flap containing said improved integrally formed carrying handle, said improved integrally formed carrying handle comprising a pair of identical, superposed, continuous curvilinear slits in said front and said back walls of said flaccid bag, each of said continuous curvilinear slits having opposed end portions, each opposed end portion defined by an outermost inwardly open arc, each of said outermost inwardly open arcs being located on a common horizontal axis, the uppermost portions of said inwardly open arcs being inwardly and downwardly extended until they transition into a centrally located, upwardly concave arc connecting said outermost inwardly open arcs to one another, whereby insertion of the supporting portion of the user's body through said pair of continuous curvilinear slits causes a portion of said flap immediately above said upwardly concave arc and a portion of said flap immediately below said centrally located, upwardly concave arc to assume a substantially horizontal orientation before said handle is subjected to tension, the portion of said flap immediately below said centrally located, upwardly concave arc forming a lowermost fold with respect to said flap, said lowermost fold connecting opposing end points of each continuous curvilinear slit to one another, said lowermost fold of said flap tending to stiffen said flap in an area adjacent the supporting portion of the user's body and thereby helping to resist movement of said opposing end points of each of said continuous curvilinear slits closer toward one another when tension is applied to the portion of said flap immediately above said centrally located, upwardly concave arc, whereby the tendency of the supporting portion of the user's body to be laterally squeezed when said bag is lifted by said integrally formed carrying handle is minimized.

2. The bag of claim 1, wherein the lowest point on said centrally located, upwardly concave arc connecting said inwardly open arcs of each continuous curvilinear slit is vertically above the lowest point on said inwardly open arcs.

3. The bag of claim 2, wherein said inwardly open arcs comprise semi-circles of equal radius.

4. The bag of claim 2 or claim 3, wherein said inwardly open arcs are separated by a horizontal distance at least equal to the total width of the fingers on the average adult human hand, exclusive of the thumb.

5. The bag of claim 1, wherein the flaccid material comprising said bag is a polymeric material.

6. The bag of claim 5, wherein said polymeric material is selected from the group consisting of polyethylenes and polypropylenes.

7. The bag of claim 5, wherein said innermost surfaces of said front and back walls of said bag are fused to one another at said first and second areas of horizontal securement.

8. The bag of claim 7, wherein said articles comprise disposable absorbent bandages.

9. The bag of claim 8, wherein said disposable absorbent bandages comprise disposable absorbent diapers or incontinence devices.

10. The bag of claim 5, wherein the innermost surfaces of said front and back walls of said bag are horizontally fused to one another in an area adjacent said lowermost fold to further stiffen said uppermost flap in an area immediately adjacent said lowermost fold.

* * * * *

UNITED STATES PATENT AND TRADEMARK OFFICE

CERTIFICATE OF CORRECTION

PATENT NO. : 4,846,587

DATED : July 11, 1989

INVENTOR(S) : WILLIAM J. HULL

It is certified that error appears in the above-identified patent and that said Letters Patent is hereby corrected as shown below:

First column, Assignee, "Proctor" should read -- Procter -- .

Column 1, line 13, "futher" should read -- further -- .

Column 1, line 54, "is" should read -- as -- .

Column 7, line 47, "3C'3C" should read -- 3C-3C -- .

Signed and Sealed this

Eighth Day of May, 1990

*Attest:*

HARRY F. MANBECK, JR.

*Attesting Officer*

*Commissioner of Patents and Trademarks*